US005413176A

United States Patent [19]

Restarick

[11] Patent Number: 5,413,176

[45] Date of Patent: May 9, 1995

[54] SAND SCREEN REPAIR

[75] Inventor: Henry L. Restarick, Houston, Tex.

[73] Assignee: Halliburton Company, Houston, Tex.

[21] Appl. No.: 183,081

[22] Filed: Jan. 18, 1994

Related U.S. Application Data

[62] Division of Ser. No. 921,922, Jul. 29, 1992, Pat. No. 5,295,538.

[51] Int. Cl.[6] ..... E21B 43/10; E21B 43/12

[52] U.S. Cl. ..... 166/277; 166/380; 166/386

[58] Field of Search ..... 166/378, 380, 74, 157, 166/158, 205, 51, 227, 228, 229, 236, 115, 116, 147, 277, 386

[56] References Cited

U.S. PATENT DOCUMENTS

| | | | |
|---|---|---|---|
| 2,673,614 | 3/1954 | Miller | 166/12 |
| 2,871,947 | 2/1959 | Fredd | 166/219 |
| 2,902,096 | 9/1959 | Stewart | 166/228 |
| 2,927,640 | 8/1960 | Kenneday | 166/205 X |
| 3,437,135 | 4/1969 | Cox et al. | 166/229 X |
| 3,997,006 | 12/1976 | Wetzel | 166/227 X |
| 4,254,832 | 3/1981 | Patton et al. | 166/147 X |
| 4,681,161 | 7/1987 | Arterbury et al. | 166/227 |
| 4,825,944 | 5/1989 | Mays | 166/51 |
| 4,856,590 | 8/1989 | Caillier | 166/51 X |
| 4,860,831 | 8/1989 | Caillier | 166/158 X |
| 5,088,554 | 2/1992 | Arterbury et al. | 166/228 |

FOREIGN PATENT DOCUMENTS

| | | | |
|---|---|---|---|
| 360678 | 11/1938 | Italy | 166/205 |

*Primary Examiner*—Hoang C. Dang

*Attorney, Agent, or Firm*—Tracy W. Druce; Dennis T. Griggs

[57] ABSTRACT

A sintered metal screen is releasably suspended from a packer mandrel by a locking mandrel and a landing nipple. The sintered metal screen and locking mandrel are retrievable with the assistance of a running tool which is insertable into the bore of the locking mandrel. According to this arrangement, the sintered metal sand screen may be removed and replaced without retrieving the packer or the production tubing. In one embodiment, the sintered metal screen is enclosed within the bore of a sliding side valve. The sliding side valve may be opened and closed as desired for selectively admitting formation fluid from various producing zones, or for isolation of a damaged screen. In another embodiment, an auxiliary sintered metal screen is inserted into the bore of a primary screen, for example, a conventional wire-wrap sand screen. The sintered metal sand screen is thus interposed in the flow path for screening out sand fines which would otherwise be conducted because of damage to the primary screen caused by corrosion or sand erosion.

8 Claims, 5 Drawing Sheets

SAND SCREEN REPAIR

CROSS-REFERENCE TO RELATED APPLICATION

This application is a division of application Ser. No. 07/921,922, filed Jul. 29, 1992, now U.S. Pat. No. 5,295,538.

FIELD OF THE INVENTION

This invention relates generally to well completion methods, and in particular to methods for repairing, replacing or isolating a sand screen in a well without retrieving the packer.

BACKGROUND OF THE INVENTION

In the course of completing an oil and/or gas well, it is common practice to run a string of casing into the well bore and then to run the production tubing inside the casing. At the well site, the casing is perforated across one or more production zones to allow production fluids to enter the casing bore. During production of the formation fluid, formation sand is also swept into the flow path, and erodes production components.

In some completions, the well bore is uncased, and an open face is established across the oil or gas bearing zone. Such open bore (uncased) arrangements are utilized, for example, in water wells, test wells and horizontal well completions. One or more sand screens are installed in the flow path between the production tubing and the perforated casing (cased) or the open well bore face (uncased). A packer is customarily set above the sand screen to seal off the annulus in the zone where production fluids flow into the production tubing. The annulus around the screen may be packed with a relatively coarse sand or gravel which acts as a filter to reduce the amount of fine formation sand reaching the screen.

DESCRIPTION OF THE PRIOR ART

Conventional sand screens employ a perforated mandrel which is surrounded by longitudinally extending spacer bars, rods or ribs and over which a continuous wire is wrapped in a carefully spaced helical configuration to provide a predetermined longitudinal gap between the wire turns. The aperture between turns permits formation fluids to flow through the screen, while the closely spaced wire turns exclude fine particulate materials such as sand or gravel which may penetrate the gravel pack.

Fine sand may be carried through the gravel pack before the gravel pack bridge stabilizes. During the early stages of producing the well after gravel packing, those fines tend to migrate through the gravel pack and screen and lodge within the inner annulus between the outer wire wrap and the perforated mandrel. In some instances, this can cause severe erosion of the screen and ultimate failure of the screen to reduce sand invasion.

One attempt to overcome the sand erosion problem is to interpose a prepack of gravel within the annulus between the inner mandrel and the outer wire screen. The prepacked gravel is sized appropriately to exclude the fines which accompany the formation fluid. Raw gravel, as well as epoxy resin coated gravel, have been used extensively in prepacked well screens. Some prepacked well screens are subject to retrieval problems due to their outer diameter being larger than that of a conventional well screen. In order to make prepacked well screens more easily retrievable, the inner mandrel is usually downsized, thereby imposing restrictions on both production and completion tool string bore sizing.

An improved sand screen which can exclude sand fines from inflowing formation fluid without limiting production of the formation fluid has recently been introduced for use in oil and gas wells. The improved sand screen includes a tubular, porous body composed entirely of sintered, powdered metal. Such a sintered metal sand screen is disclosed in U.S. Pat. No. 5,088,554 assigned to Otis Engineering Corporation, and is hereby incorporated by reference.

Because helically wrapped wires and longitudinal spacer bars are not utilized, the radial thickness of the sintered metal sand screen body provides the prepack gravel function with the desired porosity without imposing a reduction on the production bore size. The sintered metal sand screen has a unitary, tubular body of inherently stable, porous aggregate material, and has integrally formed, threaded end fittings for attachment directly to production tubing. Because of its porosity and large surface area, the sintered metal sand screen is well adapted for use in completions having relatively low entrance velocity of formation fluids, for example, in horizontal completions.

OBJECTS OF THE INVENTION

It is possible that after a conventional wire-wrap screen or a sintered metal screen has been installed in a well for a period of time, its structural integrity may be compromised by corrosion or sand erosion, in which case it may be necessary to repair, replace or isolate the damaged screen. Accordingly, the principal object of the present invention is to provide an improved method for installing a sintered metal screen in a well bore so that it can be retrieved for repair or replacement without retrieving the packer.

A related object of the present invention is to provide a method for selectively isolating a damaged sand screen.

Another object of the present invention is to provide a method for installing a sintered metal screen in combination with a damaged wire-wrap screen so that screened production can continue without removal of the damaged wire-wrap screen.

Yet another object of the present invention is to provide a method for installing an auxiliary sintered metal screen in combination with a damaged primary sintered metal screen so that screened production can continue without removal of the damaged sintered metal screen.

SUMMARY OF THE INVENTION

According to a first embodiment of the invention, a sintered metal screen is releasably suspended from a packer mandrel by a locking mandrel and a landing nipple. In this arrangement, the landing nipple is attached to the lower end of the packer mandrel, and a sintered metal screen is attached to the lower end of the locking mandrel. The locking mandrel is disposed in releasable, interlocking engagement with the landing nipple. The sintered metal screen and lock mandrel are retrievable with the assistance of a running tool which is insertable into the bore of the locking mandrel. Thus the sintered metal sand screen may be removed and replaced without retrieving the packer or the production tubing.

In a second embodiment, the sintered metal screen is suspended from a locking mandrel which is received in interlocking engagement within the bore of the landing nipple. The landing nipple is suspended from the lower end of the packer mandrel, and the sintered metal screen is enclosed within the bore of a sliding side valve. This arrangement is useful in multiple production zone completions, with the sliding side valve being opened and closed as desired for selectively admitting production in various producing zones, or for isolation of a damaged screen.

In a third embodiment, a conventional wire-wrap sand screen is suspended from a landing nipple, with the annulus being sealed above and below a producing zone by packers. In the event the conventional wire-wrap screen should become damaged by erosion or corrosion, rather than replacing the screen, a sintered metal screen is run into the bore of the conventional wire-wrap screen. The sintered metal sand screen is suspended from the landing nipple by a releasable lock mandrel. The sintered metal sand screen is thus interposed in the flow path for screening out sand fines which are conducted through the damaged conventional WIRE-WRAP screen.

In yet another embodiment, a sintered metal sand screen is fitted about the mandrel of a sliding side valve circulation tool. Flow from the well is conducted through the sintered metal screen and flows into the production tubing via the ports in the sliding side valve. The sliding side valve circulation tool may be opened and closed in both single and multizone completions for production control purposes, or for isolation of a damaged screen.

According to another embodiment, a sintered metal sand screen is suspended from a hanger packer in a through-tubing completion.

Other features and advantages of the present invention will be appreciated by those skilled in the art upon reading the detailed description which follows with reference to the attached drawings.

DETAILED DESCRIPTION OF THE PREFERRED EMBODIMENTS

Figure 1:
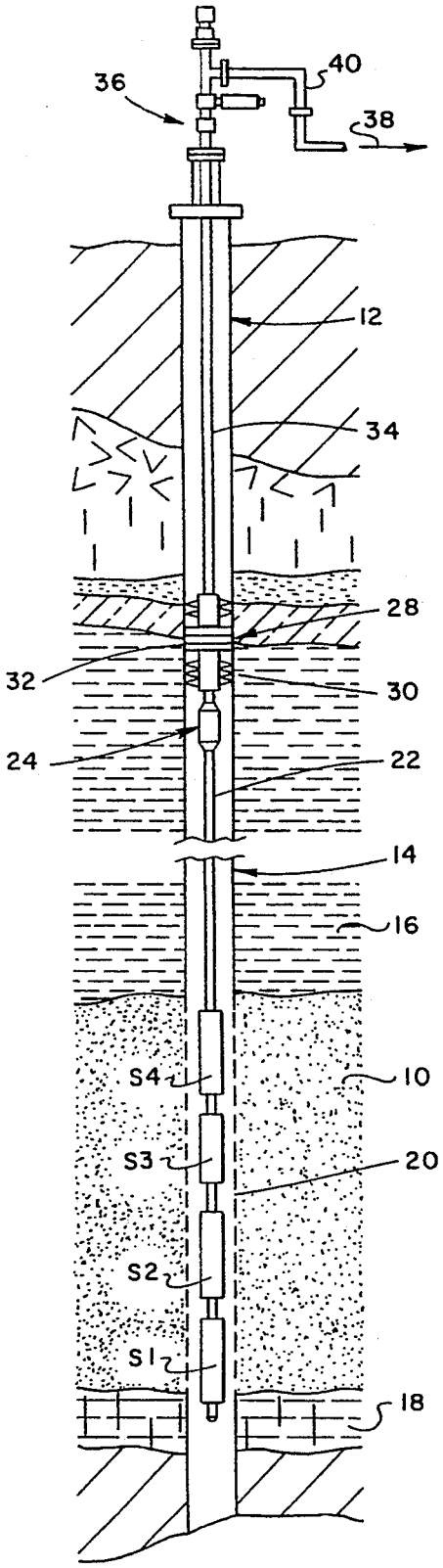
FIG. 1 is a simplified, schematic diagram showing a vertical section through a hydrocarbon formation which is intersected by a production well which has been completed with a sintered metal sand screen which is releasably suspended from a packer according to the teachings of the present invention.

In the description which follows, like parts are indicated throughout the specification and drawings with the same reference numerals, respectively. The drawings are not necessarily to scale and the proportions of certain parts have been exaggerated to better illustrate details of the invention.

Referring now to FIG. 1, a hydrocarbon formation 10 is intersected by a production well 12. A tubular string of well casing 14 extends through multiple layers of overburden 16, traversing the hydrocarbon formation 10, and intersecting one or more layers of underburden 18. The tubular casing sections 14 which intersect the hydrocarbon formation 10 are perforated by multiple openings 20 formed through the casing sidewall to permit inflow of formation fluids from the adjoining hydrocarbon bearing formation 10.

The hydrocarbon formation 10 is confined vertically between the overburden layer 16 and the underburden layer 18, typically of an impervious siltstone or other barren rock. The sand screen assembly of the present invention is particularly well adapted to a generally horizontally aligned hydrocarbon formation, such as the formation 10 as illustrated, having a thickness ranging from about 100 feet to about 500 feet. For illustrative purposes, the hydrocarbon formation 10 is described at a depth of 7,500 feet, with a reservoir pressure of 2,000 psi and a reservoir temperature of 130 degrees F. The overburden layer 16 and the subjacent underburden layer 18 are impervious to the flow of gas.

Figure 2:
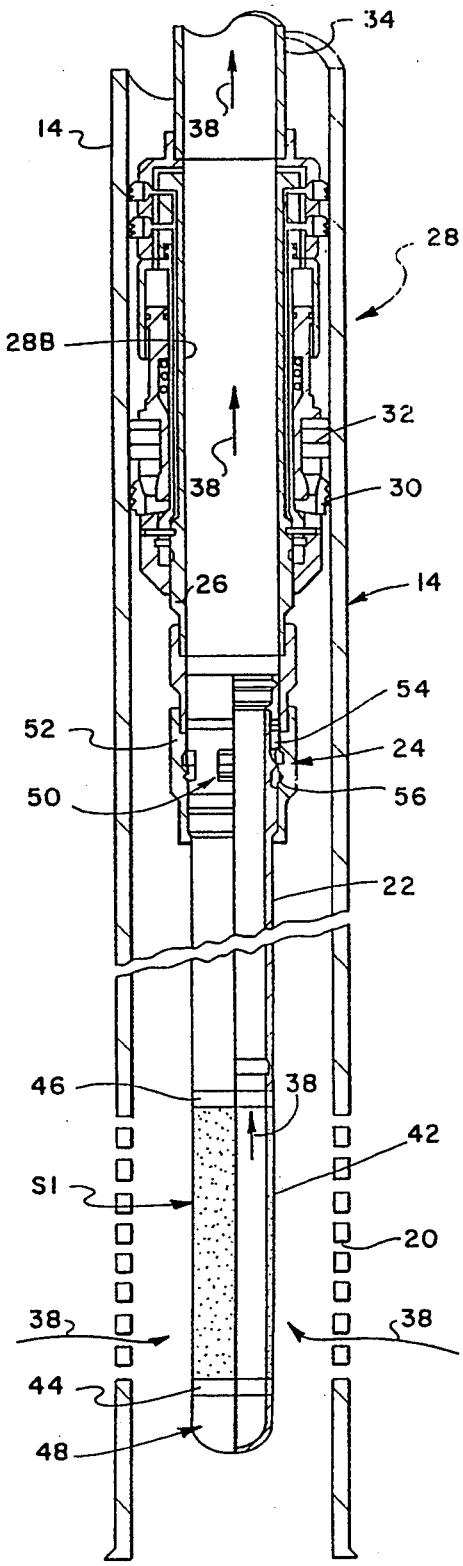
FIG. 2 is a simplified, sectional view which illustrates the releasable attachment of a sintered metal sand screen to the lower end of a packer mandrel.

Referring now to FIG. 1 and FIG. 2, the production well 12 is completed by multiple screens S1, S2, S3, S4 which are supported by a lower tubing string 22. The lower tubing string 22 is suspended from landing nipple 24 attached to the mandrel 26 of a production packer 28. The production packer 28 includes anchor slips 30 and an elastomeric seal 32 which releasably secure and seal the packer against the bore of the tubular well casing 14. Formation fluid produced through the screens S1–S4 and the production tubing 22 flows to the surface through an upper tubing string 34 to a wellhead assembly 36. The wellhead assembly 36 supports the upper end of the production tubing string 34 and seals the casing 14. Formation fluid 38 is conveyed to a surface reservoir through a production flow line 40.

The sand screens S1, S2, S3 and S4 have substantially identical construction, each having a tubular screen body 42 which is a unitary, porous body of sintered powdered metal. The metal preferably is a corrosion resistant metal such as stainless steel or nickel and nickel chromium alloys such as are sold under the trademarks MONEL and INCONEL. In this embodiment, the sintered metal screen body provides a matrix having a pore size of about 100–150 microns, corresponding to 40–60 mesh. The screen S1 has tubular end portions 44, 46 which are fitted with threaded connections for attachment to the production tubing 22 on the upper end, and for attachment to a bull plug 48 on the lower end. The bull plug seals the lower end of the sand screen bore, thus constraining the formation fluid 38 to flow through the porous sidewall 42 and upwardly through the production bores of the tubing 22 and tubing 34.

It will be appreciated that the sand screens S1, S2, S3 and S4 are subject to damage by corrosive fluids as well as sand fines which are swept into the flow path. Accordingly, it may be necessary to repair or replace the sand screens from time to time. According to an important feature of the present invention, the sand screens are releasably suspended from the packer 28 by a locking mandrel 50 which is disposed in releasable, interlocking engagement with the landing nipple 24. In this arrangement, the landing nipple 24 is attached to the lower end of the packer mandrel 26. The landing nipple 24 has a tubular mandrel 52 which is intersected by a longitudinal bore 54 which is connected in flow communication with the packer mandrel bore 28B. The landing nipple mandrel 52 is radially intersected by an internal annular slot 56 for receiving a radially deflectable locking key 58 carried by the locking mandrel 50. As can be seen in FIG. 2, the locking mandrel 50 is received in releasable, interlocking engagement with the landing nipple 24. The lower tubing string 22 is attached to the locking mandrel 50, thus suspending the sand screens S1, S2, S3 and S4 at the appropriate depth corresponding with the production zone 10.

The sintered metal screens S1–S4, the lower tubing string 22 and the locking mandrel are retrievable with the assistance of a running tool which is insertable into the bore of the locking mandrel 50. When the running tool engages the locking mandrel, locating dogs on the running tool engage and locate the lower end of a nipple hone bore. Further upward movement through the nipple results in the running tool causing an expander sleeve to move down, which offsets the bend in the bias springs. This causes the bias springs and the locking keys to move to the locating position. The locking keys flex from the locating position to the retracted position when being pulled across the nipple locator dogs. Thus, installation and retrieval of the sand screens can be carried out, without removing the packer.

Figure 3:
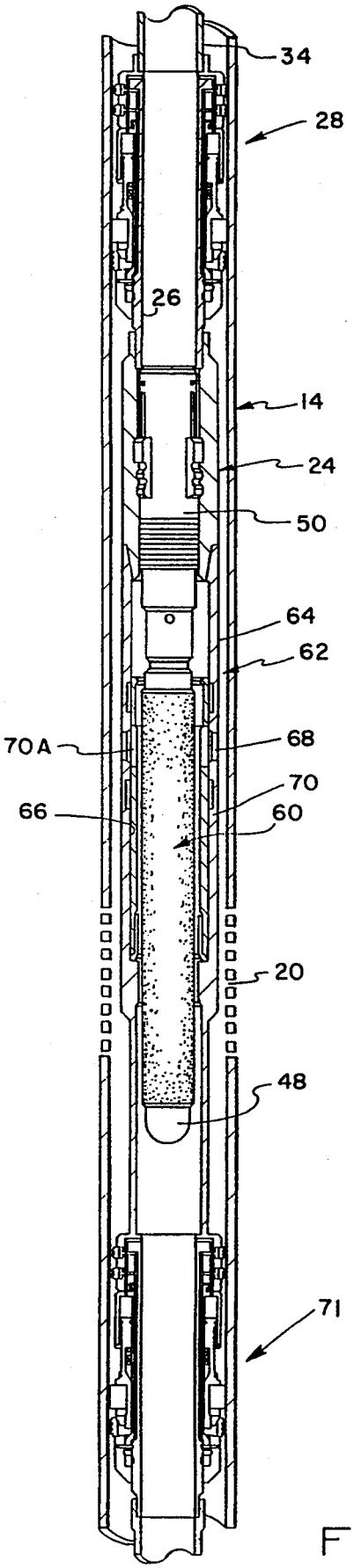
FIG. 3 is a simplified, sectional view which illustrates the releasable installation of a sintered metal sand screen within the bore of a sliding side valve.

Referring now to FIG. 3, a sintered metal sand screen 60 is suspended from the locking mandrel 50. The landing nipple 24 is secured to the packer mandrel 26 and the sintered metal screen 60 is suspended from the lower end of the locking mandrel 50, as previously discussed. In addition, the sintered metal screen 60 is enclosed within the bore of a sliding side valve 62. The sliding side valve 62 is a circulation tool having a tubular mandrel 64 intersected by a longitudinal production bore 66 and having a sidewall portion radially intersected by a circulation port 68. A tubular sleeve 70 is slidably received within the bore of the circulation sub for opening and closing the circulation port 68. The circulation sub mandrel 64 is connected at its upper end to the landing nipple 24, and at its lower end to a second production packer 71.

According to this arrangement, the first production packer 28 and the second production packer 71 isolate the annulus within a production zone. Formation fluid entering through the well casing perforations 20 flows through the flow port 68 of the circulation sub 62. Because the lower end of the sintered metal sand screen 60 is sealed by the bull plug 48, the formation fluid is constrained to flow through the sintered metal sidewall of the sand screen 60, and upwardly through the bore of the first production packer 24. The sintered metal sand screen 60 can be retrieved as previously discussed, and the sliding side door sleeve valve can be moved to the closed position, thereby blocking the flow port 68 and isolating the production zone, without removing the production packers 28, 71.

Figure 4:
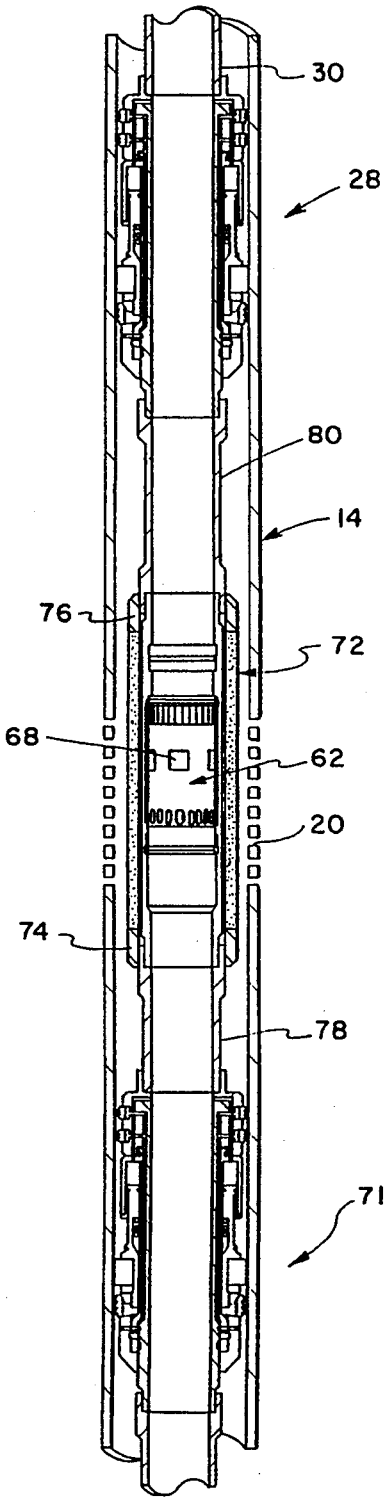
FIG. 4 is a simplified, sectional view which illustrates the assembly of a sliding side valve as the internal mandrel for a sintered metal screen.

Referring now to FIG. 4, a sintered metal sand screen 72 is fitted about the circulation sub 62. The sintered metal sand screen 72 has tubular end portions 74, 76 which are fitted with threaded connections for attachment to connecting subs 78, 80, respectively. The connecting subs 78, 80 connect the circulation sub 62 to the mandrel of the packer 28, and to the mandrel of the lower packer 71. The end collars 74, 76 are attached to the connecting subs by threaded fittings, or alternatively, by welds.

Figure 5:
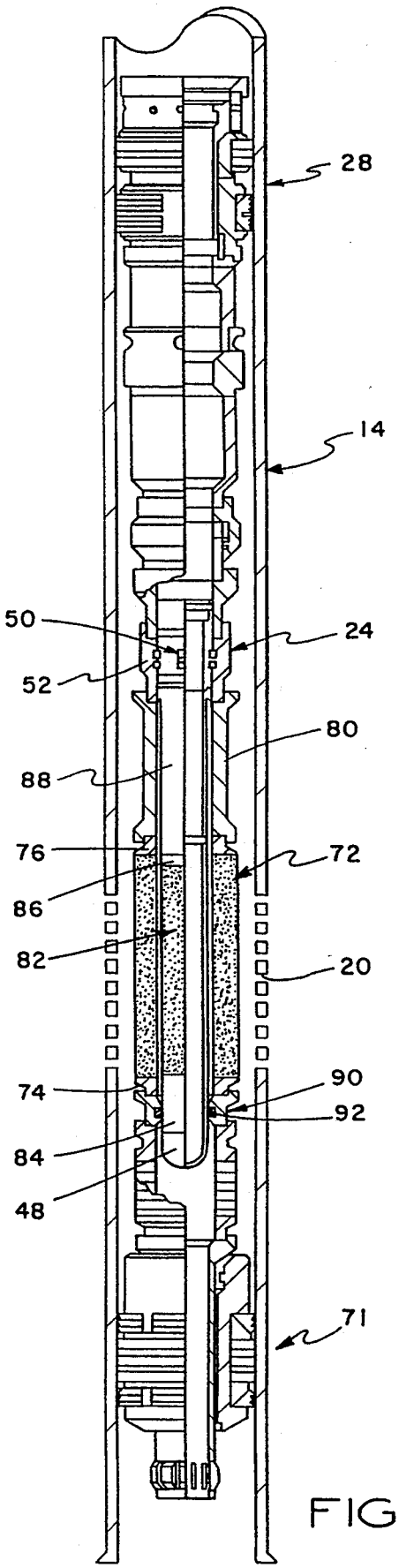
FIG. 5 is a simplified, sectional view which illustrates the installation of an auxiliary sintered metal sand screen within the bore of a primary sand screen.

Referring now to FIG. 5, the sintered metal sand screen 72 is suspended from the landing nipple 24 by the connecting sub 80. In this embodiment, the sintered metal sand screen 72 serves as a primary sand screen, and its operation is enhanced by an auxiliary sand screen 82. In this arrangement, the well annulus in the production zone is isolated by the upper and lower production packers 28, 71 as previously discussed. Formation fluid enters through the well casing perforations 20 and is conducted through the permeable sidewall of the primary sintered metal screen 72. If the primary screen 72 should become damaged by sand erosion or corrosion, rather than replacing the screen 72, the auxiliary sintered metal screen is run into the bore of the primary screen as shown in FIG. 5. According to this arrangement, the auxiliary sintered metal sand screen 82 is interposed in the flow path for screening out sand fines which are conducted through the damaged primary sand screen.

The lower end of the auxiliary sintered metal sand screen 82 is sealed by a bull plug 48. The auxiliary sand screen 82 is provided with end collars 84, 86. The upper collar 86 is fitted with threads for attachment to a coupling sub 88. The lower coupling collar 84 has a polished external surface. The lower polished collar 84 is coupled in sealing engagement with a coupling collar 90 connected to the lower end of the auxiliary sand screen 82. The coupling collar 90 has a polished bore for receiving the polished external surface of the collar 84. The interface between the sealing collar 84 and the coupling collar 90 is sealed by an annular O-ring seal 92. According to this arrangement, formation fluid from below the lower production packer 71 is blocked, and only formation fluid entering through the well casing perforations 20 in the production zone enter through the primary sintered metal sand screen 72.

Figure 6:
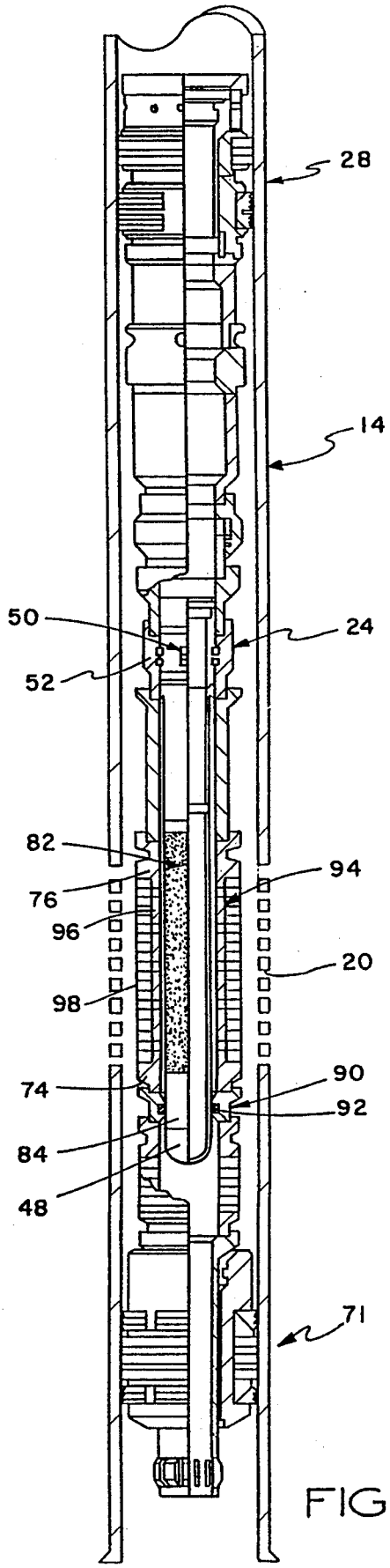
FIG. 6 is a view similar to FIG. 5 which illustrates the releasable installation of a sintered metal sand screen within a conventional wire-wrap screen.

Referring now to FIG. 6, a similar installation is disclosed in which the primary sand screen is a conventional wire-wrap screen 94. The primary sand screen 94 has a perforated inner mandrel 96 and a screen wire 98 wrapped in a helical path externally about the perforated mandrel, thereby defining longitudinally spaced, outer screen apertures for conducting formation fluid through the primary screen. Should the primary screen 94 be damaged by corrosion or erosion, the auxiliary sintered metal screen 82 is run into its bore, thereby intercepting sand fines which are conducted through the damaged portions of the primary screen. Accordingly, production can be continued from the producing zone without replacing the damaged primary screen.

Figure 7:
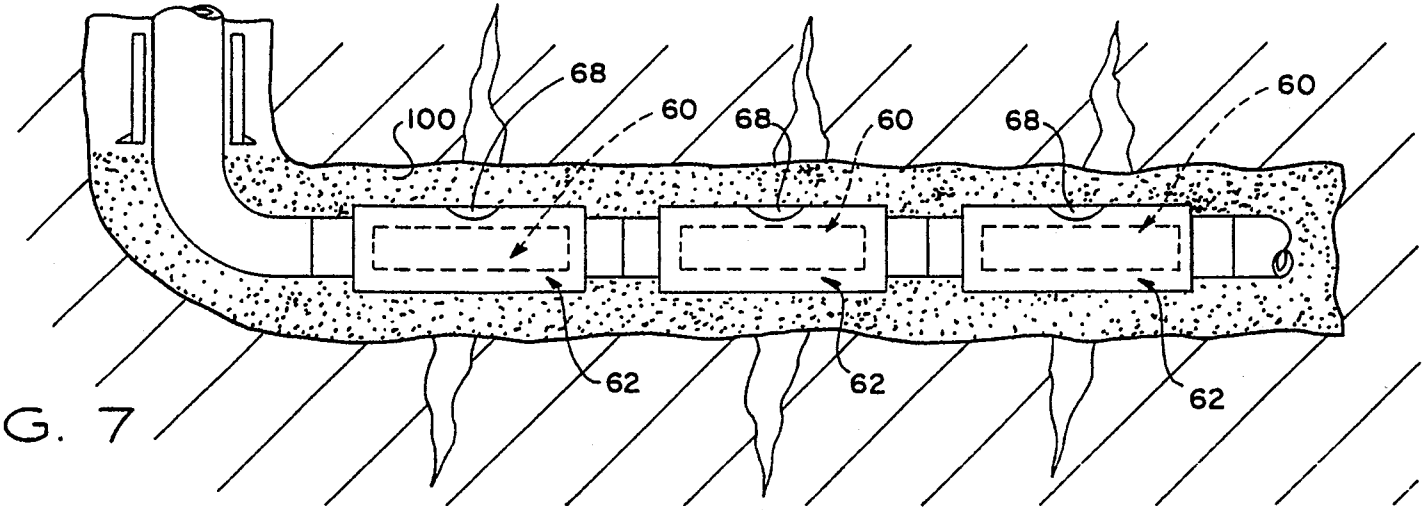
FIG. 7 is a simplified, sectional view which illustrates a horizontal well completion in an uncased bore hole, in which a section of sintered metal screen is enclosed within the bore of a sliding side valve.

Referring now to FIG. 7, multiple sintered metal sand screens 60 are shown enclosed within circulation sub 62 which are connected in a series configuration within a horizontal well completion in an uncased well bore 100. Because of the porosity and large surface area provided by the sintered metal sand screens 60, they are well adapted for use in horizontal completions in which the producing formation is characterized by relatively low entrance velocity of formation fluid.

Figure 8:
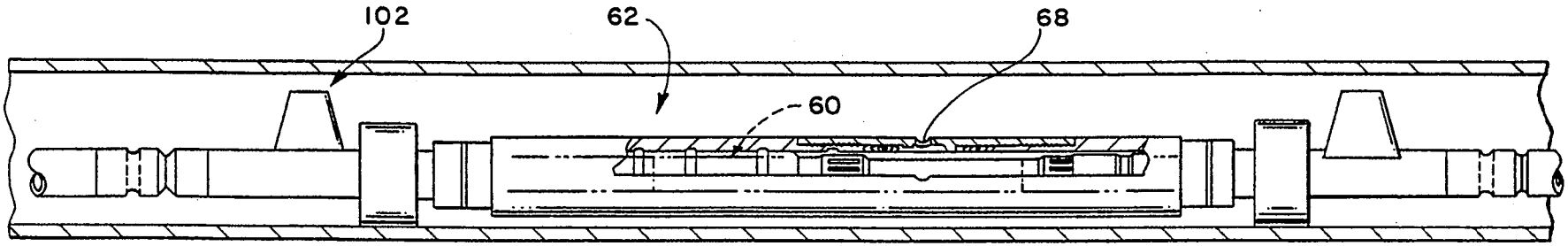
FIG. 8 is a simplified, sectional view which illustrates a horizontal well completion in a cased bore hole, in which a section of sintered metal screen is enclosed within the bore of a sliding side valve; and, FIG. 9 is a simplified, sectional view which illustrates installation of a sintered metal sand screen assembly where support is provided by a hanger packer in a through-tubing completion.

A similar horizontal completion is illustrated in FIG. 8, in which the bore hole is reinforced by a horizontal casing. In this arrangement, the circulation sub 62 is positioned by an orienting tool 102, as disclosed in U.S. Pat. No. 5,107,927, assigned to Otis Engineering Corporation, and incorporated herein by reference.

Figure 9:
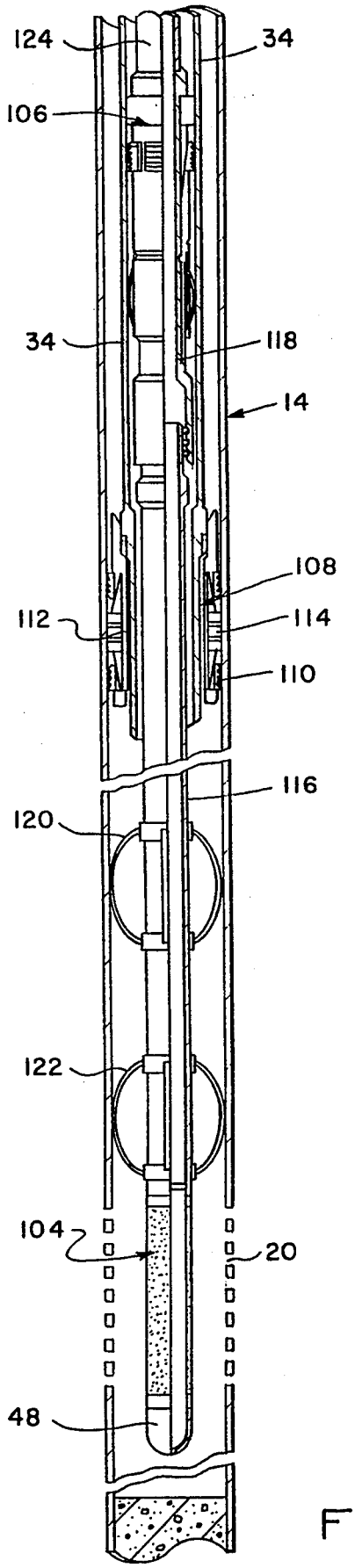

Referring now to FIG. 9, a sintered metal sand screen 104 is suspended from a hanger packer 106 in a through-tubing completion. Such completions may be used, for example, in offshore installations, in which it is desirable that the tubing weight be transferred to the casing 14 below the mud line. It is also intended for installations where it is desirable to retrieve and reinstall tubing removable safety valves without disturbing the production tubing or the downhole production packer.

In the through-tubing embodiment of FIG. 9, the upper production tubing string 34 is stabbed and sealed against the mandrel bore of a production packer 108. The production packer 108 is equipped with anchor slips 110 which are movably mounted on a tubular body mandrel 112 for radial expansion into set engagement against the well casing 14. The production packer 108 is also equipped with annular seal elements 114 which are expandable into sealing engagement against the well casing 14.

The sintered metal sand screen 104 is coupled to the hanger packer 106 by a tubular extension sub 116 and an overshot tubing seal divider 118. The sand screen 104 and the extension sub 116 are centered within the bore of the well casing 14 by bow spring centralizers 120, 122. The hanger packer 106, tubular extension sub 116, and the sintered metal sand screen 114 may be suspended within the upper production tubing 34 by various means, including a braided line, reeled tubing or, as shown in this exemplary embodiment, a jointed string of auxiliary production tubing 124. The auxiliary production tubing string 124 is concentrically disposed within the upper production tubing string 34, and is releasably attached to the wellhead 36 at the surface.

The through-tubing installation shown in FIG. 9 permits most of the tubing weight of the sand screen assembly, extension sub, and hanger packer to be transferred to the casing below the mud line, or at some other predetermined point downhole where the well casing has good lateral support. The hanger packer 106 is designed for release from the well casing with a straight upward pull, so that the sintered metal sand screen 104 may be retrieved to the surface for replacement, without disturbing the production packer 108 or the primary production tubing 34.

The invention has been described with reference to certain exemplary embodiments, and in connection with vertical as well as horizontal well completions. Various modifications of the disclosed embodiments as well as alternative well completion applications of the invention will be suggested to persons skilled in the art by the foregoing specification and illustrations. It is therefore contemplated that the appended claims will cover any such modifications or embodiments which fall within the true scope of the invention.

What is claimed is:

1. A method for selectively isolating a sand screen comprising the steps:

suspending the sand screen within the production bore of a circulation sub of the type having a longitudinal production bore and a radial circulation port for selectively admitting formation fluid into the production bore; and, opening and closing the circulation port for selectively admitting formation fluid into the production bore of the circulation sub and for isolating the sand screen, respectively.

2. A method for selectively isolating a sand screen as defined in claim 1, including the steps:

connecting a landing nipple in flow communication with the production bore of a packer;

connecting the circulation sub to the landing nipple;

connecting the sand screen to one end of a releasable locking mandrel;

releasably connecting the locking mandrel to the landing nipple; and, running the packer with the connected landing nipple, locking mandrel, circulation sub and screen into a well and setting the packer against a well casing.

3. A method for selectively isolating a sand screen as defined in claim 1, including the steps:

connecting a landing nipple in flow communication with the production bore of a packer;

connecting a circulation sub to the landing nipple;

running the packer with the connected landing nipple and circulation sub into a well and setting the packer against a well casing;

connecting the sand screen to one end of a releasable locking mandrel; and, running the sand screen and locking mandrel assembly through the packer production bore into interlocking engagement with the landing nipple.

4. A method for selectably isolating a sand screen comprising the steps:

enclosing a circulation sub within the flow bore of a sand screen, the circulation sub being of the type having a longitudinal production bore and a radial circulation port for selectively admitting formation fluid into the longitudinal production bore;

sealing the annulus between the sand screen and the circulation sub at first and second locations which are longitudinally spaced from the circulation port; and, opening and closing the circulation port for selectively admitting formation fluid into the production bore of the circulation sub and for isolating the enclosed circulation sub, respectively.

5. A method for selectively isolating a sand screen as defined in claim 4, including the steps:

connecting the circulation sub between first and second packers each having a production bore, respectively, with the production bore of the circulation sub being coupled in flow communication with the production bore of the first packer and in flow communication with the production bore of the second packer;

running the assembled packers, sand screen and enclosed circulation sub into a well; and setting and sealing the first and second packers against a well casing.

6. A method for repairing a primary sand screen having a production bore disposed within a well without retrieving the primary sand screen comprising the steps:

suspending the primary sand screen from a packer having a production bore;

suspending an auxiliary sand screen having a production bore from the packer with the production bore of the auxiliary screen being coupled in flow communication with the packer production bore;

enclosing the auxiliary sand screen within the bore of the primary sand screen; and, sealing the annulus between the primary sand screen and the auxiliary sand screen and sealing the production bore of the auxiliary sand screen whereby formation fluid conducted through the primary sand screen is constrained to flow through the auxiliary sand screen.

7. A method for repairing a primary sand screen as defined in claim 6, including the steps:

suspending the auxiliary sand screen from the packer through a releasable coupling apparatus which may be locked, released, and retrieved through the packer production bore with the assistance of a retrieving tool which is insertable through the packer production bore.

8. A method for repairing a primary sand screen as defined in claim 7, including the steps:

connecting a landing nipple to the packer mandrel;

running the packer and landing nipple assembly into a well and setting the packer against a well casing;

connecting the auxiliary sand screen to one end of a releasable locking mandrel; and, running the auxiliary sand screen with the connected locking mandrel through the packer production bore into interlocking engagement with the landing nipple.

* * * * *